US006468236B1

(12) United States Patent
Sumanac

(10) Patent No.: US 6,468,236 B1
(45) Date of Patent: Oct. 22, 2002

(54) VIBRATING MASSAGE TABLE

(76) Inventor: Douglas Sumanac, 9939 - 170 Avenue, Edmonton, Alberta (CA), T5Y 3G3

( * ) Notice: Subject to any disclaimer, the term of this patent is extended or adjusted under 35 U.S.C. 154(b) by 75 days.

(21) Appl. No.: 09/625,575

(22) Filed: Jul. 25, 2000

(51) Int. Cl.[7] ..... A61H 1/00

(52) U.S. Cl. ..... 601/49; 601/56; 601/58; 601/59; 601/60

(58) Field of Search ..... 601/49, 51, 53, 601/54, 56, 57, 58, 59, 60, 67, 69, 70, 24, 26, 33, 34

(56) References Cited

U.S. PATENT DOCUMENTS

| | | | | | |
|---|---|---|---|---|---|
| 3,640,272 | A | * | 2/1972 | Hussey | 128/33 |
| 3,732,860 | A | * | 5/1973 | Thurmer | 128/33 |
| 3,817,243 | A | * | 6/1974 | Perrine | 128/57 |
| 4,546,764 | A | * | 10/1985 | Gerber | 128/33 |
| 4,736,735 | A | | 4/1988 | Yong | 128/41 |
| 4,969,451 | A | * | 11/1990 | Totten | |
| 5,716,331 | A | * | 2/1998 | Chang | |
| 5,910,123 | A | * | 6/1999 | Wang | 601/50 |

FOREIGN PATENT DOCUMENTS

| | | |
|---|---|---|
| BE | 869922 | 12/1978 |
| DE | 1937829 | 4/1970 |

* cited by examiner

*Primary Examiner*—Michael A. Brown
*Assistant Examiner*—Benjamin K. Koo
(74) *Attorney, Agent, or Firm*—Christensen O'Connor Johnson Kindness PLLC

(57) ABSTRACT

A vibrating massage table includes a base, a plurality of resilient support members secured to the base, and a platform supported by the resilient support members. An eccentric drive is connected to some of the plurality of resilient support members, such that eccentric operation of the eccentric drive transmits vibrations along the resilient support members to the platform.

7 Claims, 3 Drawing Sheets

VIBRATING MASSAGE TABLE

FIELD OF THE INVENTION

The present invention relates to a vibrating massage table for therapeutic massage.

BACKGROUND OF THE INVENTION

U.S. Pat. No. 4,736,735 issued to Yong in 1988 for an invention entitled "Back Massager with Two Support Bars for Back". The Yong reference discloses a massage table having a back support which includes two laterally spaced longitudinally extending parallel support bars. A series of vibrators are connected to the support bars. The vibrators transmit vibrations to the support bars for massaging a back of a person resting upon the massage table with his or her back against the support bars.

Although beneficial effects may be obtained through the use of the Yong reference, it delivers a relatively passive massage.

SUMMARY OF THE INVENTION

What is required is a vibrating massage table that is capable of giving a deeper more aggressive massage.

According to the present invention there is provided a vibrating massage table which includes a base, a plurality of resilient support members secured to the base, and a platform supported by the resilient support members. Eccentric drive means are connected to at least some of the plurality of resilient support members, such that eccentric operation of the eccentric drive means transmits vibrations along the resilient support members to the platform.

The vibrating massage table, as described above, delivers vibrations to the platform. When a gentle massage is required, those vibrations can be gentle. When a more aggressive massage is required the intensity of the vibrations can be dramatically increased.

Although beneficial results may be obtained through the use of the vibrating massage table, as described above, there are times when it is desirable to direct vibrations to a particular region of the body. Even more beneficial results may, therefore, be obtained when the vibrating massage table is used in combination with a roller positioned transversely across the platform.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 2:
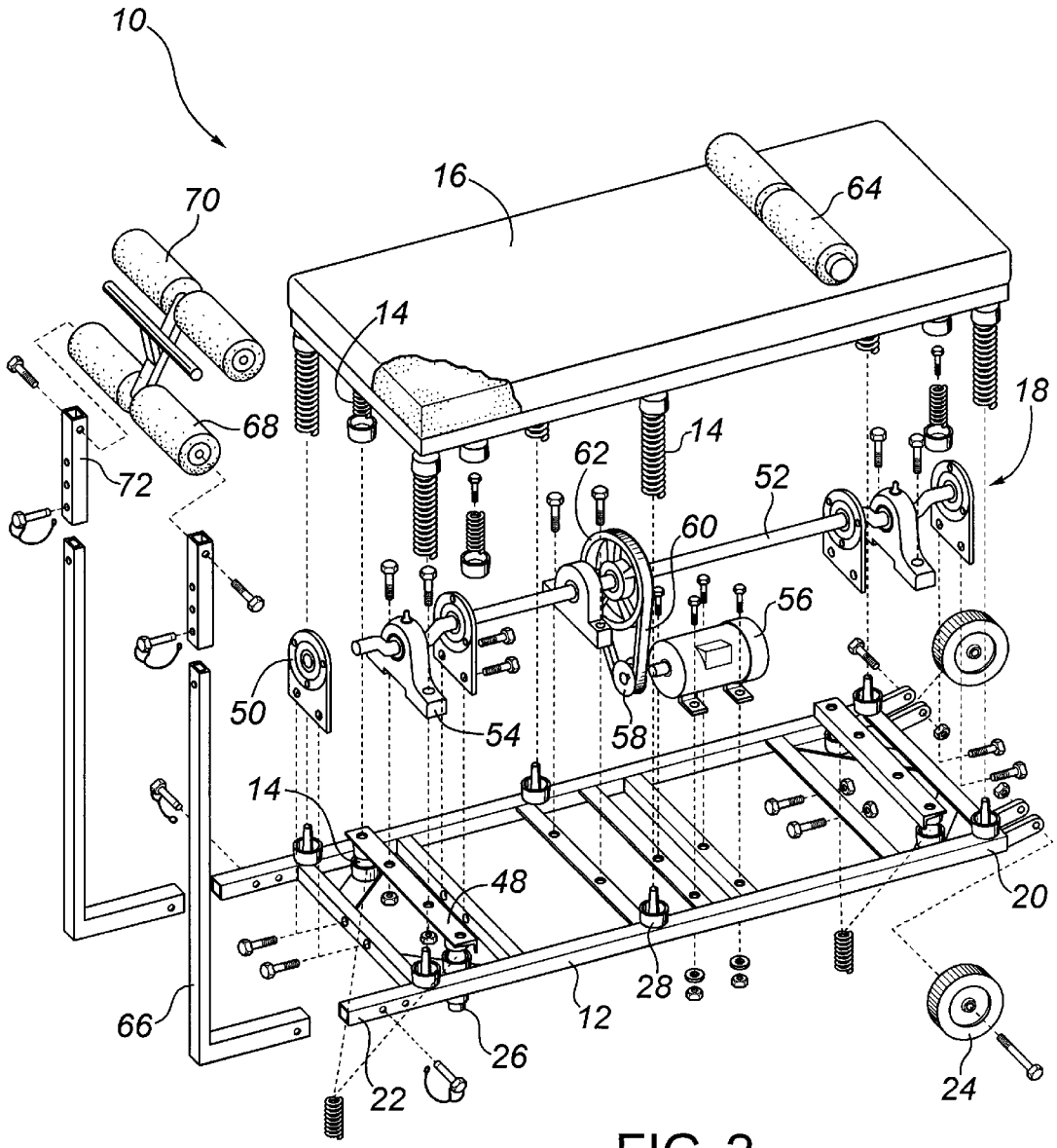
FIG. 2 is an exploded side elevation view of the vibrating massage table illustrated in FIG. 1.
Figure 3:
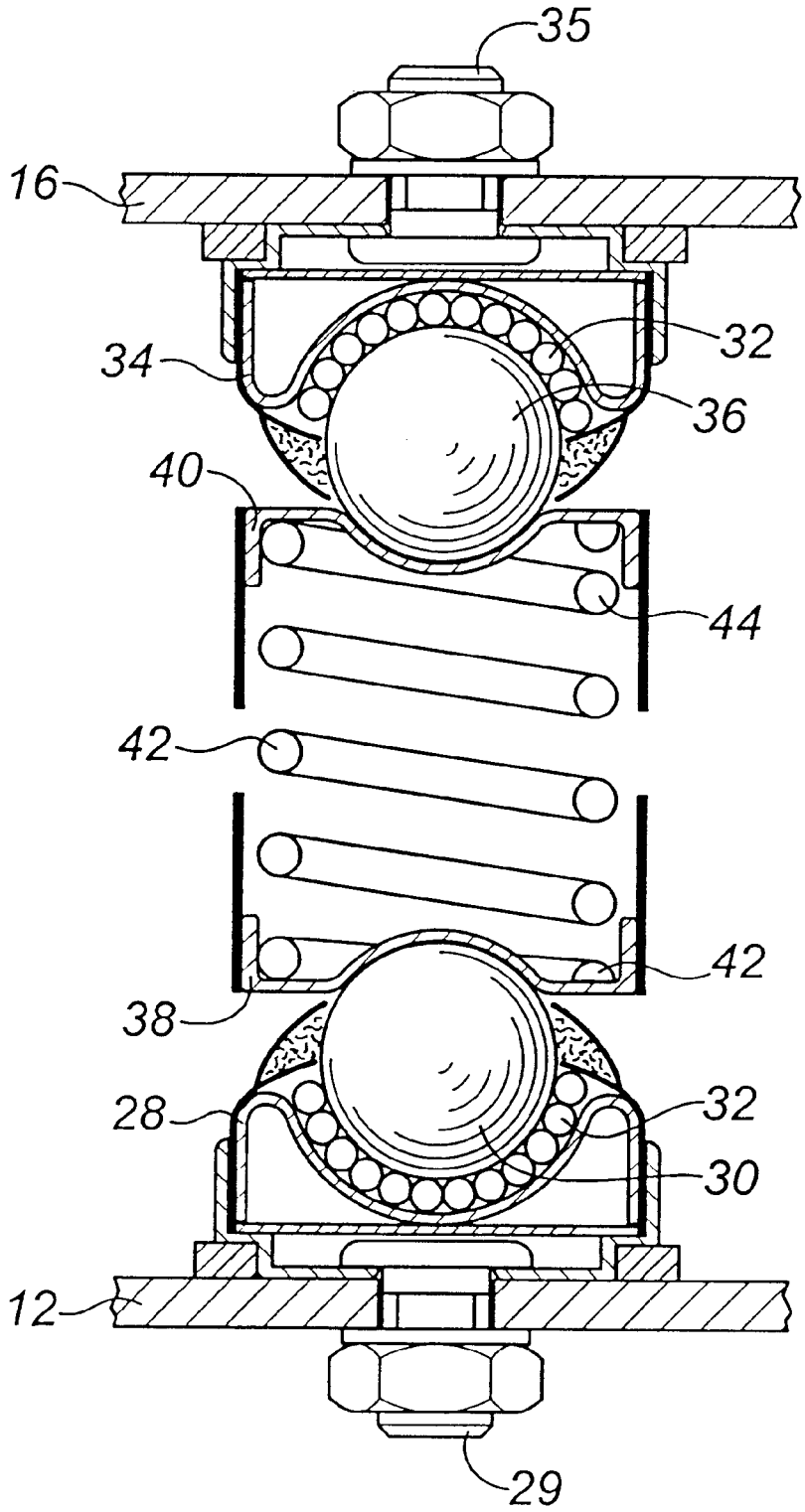
FIG. 3 is a detailed side elevation view, in section, of a resilient support member illustrated in FIG. 2.

The preferred embodiment, a vibrating massage table generally identified by reference numeral 10, will now be described with reference to FIGS. 1 through 3.

Figure 1:
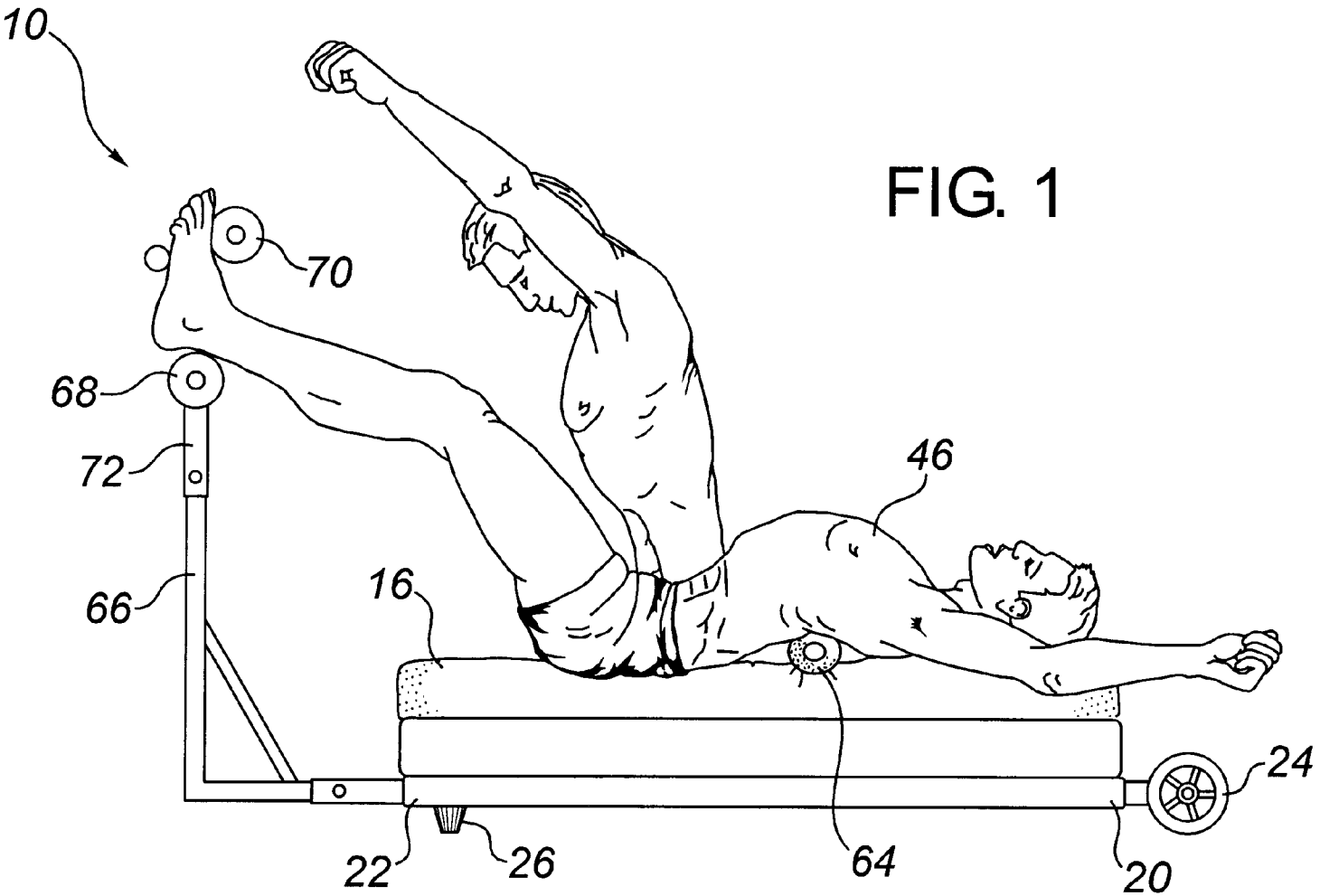
FIG. 1 is a side elevation view of a vibrating massage table constructed in accordance with the teachings of the present invention.

Vibrating massage table 10 is illustrated in FIG. 1. Referring to FIG. 2, the main components of vibrating massage table 10 include a base 12, resilient support members 14, a platform 16 and an eccentric drive assembly generally indicated by reference numeral 18. Base 12 is a frame structure having a first end 20 and a second end 22. Wheels 24 are mounted at first end 20. Feet 26 are positioned adjacent to second end 22. There are a plurality of resilient support members 14. Most of resilient support members 14 are secured directly to base 12. However, some of resilient support members 14 are secured indirectly to base 12 as part of a coupling with eccentric drive assembly 18, as will hereinafter be further described. Referring to FIG. 3, each of resilient support members 14 includes a lower socket 28 which is attached to base 12 by means of bolt 29. A lower transfer ball 30 is disposed in the lower socket and rests upon a plurality of bearings 32. An upper socket 34 is attached to platform 16 by means of bolt 35. An upper transfer ball 36 is disposed in upper socket 34 and, similarly, rests upon a plurality of bearings 32. Positioned on top of lower transfer ball 30 is a lower spring receiving cup 38. Portioned below upper transfer ball 36 is an upper spring receiving cup 40. A spring 42 is provided having a lower end 42 positioned in lower spring receiving cup 38 and an upper end 44 positioned in upper spring receiving cup 40. The force of spring 42 holds lower spring receiving cup 38 and upper spring receiving cup 40 in position. Referring to FIG. 1 platform 16 is padded for the comfort of a person 46 receiving a therapeutic vibrating massage. Referring to FIG. 2, platform 16 is supported by resilient support members 14. Eccentric drive means 18 includes a pair of mounting members 48 secured transversely to base 12 in spaced apart relation by means of miniature versions of resilient support members 14. As previously described some of resilient support members 14 are secured to each of mounting members 48. A plurality of shaft supports 50 secured to base 12. An eccentrically rotating shaft 52 journalled for rotation in shaft supports 50. Motion transmission members 54 mounted to each of mounting members 48 and coupled with eccentrically rotating shaft 52. A drive motor 56 mounted on base 12 and coupled by means of an output pulley 58 and drive belt 60 with a pulley 62 on shaft 52. Drive motor 56 is, preferably, a variable speed motor in order that the intensity of the vibrating action may be varied.

Referring to FIG. 1, it is preferred that vibrating massage table 10 be used in combination with a roller 64 which is positioned transversely across platform 16. It is also preferred that person 46 perform sit up exercises while using vibrating massage table 10. To facilitate sit up exercises it is preferred that vertical supports 66 be secured to second end 22 of platform 16. Rollers 68 and 70 are secured in spaced relation at a remote end 72 of vertical supports 66 in order to serve as ankle retaining members.

The use and operation of vibrating massage table 10 will now be described with reference to FIGS. 1 through 3. Roller 64 is positioned transversely across platform 16. Person 46 then lays on platform 16 with roller 64 positioned under that portion of the anatomy of person 46 that is need of therapeutic massage. Drive motor 56 provides motive force to rotate shaft 52. The eccentric rotation of shaft 52 is transmitted through motion transmission members 54 shaking mounting members 48 and causing vibration which migrates along resilient support members 14 to platform 16. When person 46 is receiving therapeutic massage for back problems, it is preferred that sit up exercises be intermittently performed during the massage. Person 46 then places his or her ankles between rollers 68 and 70 and performs sit up exercises in short sets of 5–7 repetitions.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A vibrating massage table, comprising:

a base;

a plurality of resilient support members secured to the base;

a platform supported by the resilient support members; and an eccentric drive connected to at least some of the plurality of resilient support members, the eccentric drive including a pair of mounting members secured by springs to the base in spaced apart relation, some of the plurality of resilient support members being secured to each of the mounting members, shaft supports secured to the base, an eccentrically rotating shaft journalled for rotation in the shaft supports, motion transmission members mounted to each of the mounting members and coupled with the eccentrically rotating shaft, a drive motor mounted on the base and coupled with the shaft, such that the drive motor provides motive force to rotate the shaft the eccentric rotation of the shaft shaking the mounting members and causing vibration which migrates along the resilient support members to the platform.

2. The vibrating massage table as defined in claim 1, in combination with a roller positioned transversely across the platform.

3. The vibrating massage table as defined in claim 1, wherein each of the resilient support members include:

a lower socket;

a lower transfer ball disposed in the lower socket;

an upper socket;

an upper transfer ball disposed in the upper socket;

a lower spring receiving element for coupling the lower transfer ball with a lower end of a spring;

an upper spring receiving element for coupling the upper transfer ball with an upper end of a spring; and a spring having a lower end engaging the lower spring receiving element and an upper end engaging the upper spring receiving element.

4. The vibrating massage table as defined in claim 1, wherein at least one vertical support is secured at one end of the platform with ankle retaining members positioned at a remote end of the at least one vertical support.

5. A vibrating massage table, comprising:

a base;

a plurality of resilient support members secured to the base, each of the resilient support members including:

a lower socket;

a lower transfer ball disposed in the lower socket;

an upper socket;

an upper transfer ball disposed in the upper socket;

a lower spring receiving element for coupling the lower transfer ball with a lower end of a spring;

an upper spring receiving element for coupling the upper transfer ball with an upper end of a spring; and a spring having a lower end engaging the lower spring receiving element and an upper end engaging the upper spring receiving element;

a platform supported by the resilient support members; and an eccentric drive including a pair of mounting members secured by springs to the base in spaced apart relation, some of the plurality of resilient support members being secured to each of the mounting members, shaft supports secured to the base, an eccentrically rotating shaft journalled for rotation in the shaft supports, motion transmission members mounted to each of the mounting members and coupled with the eccentrically rotating shaft, a drive motor mounted on the base and coupled with the shaft, such that the drive motor provides motive force to rotate the shaft the eccentric rotation of the shaft shaking the mounting members and causing vibration which migrates along the resilient support members to the platform.

6. The vibrating massage table as defined in claim 5, in combination with a roller positioned transversely across the platform.

7. The vibrating massage table as defined in claim 5, wherein at least one vertical support is secured at one end of the platform with ankle retaining members positioned at a remote end of the at least one vertical support.

* * * * *